US007965129B1

(12) United States Patent
Wadhwa et al.

(10) Patent No.: US 7,965,129 B1
(45) Date of Patent: Jun. 21, 2011

(54) TEMPERATURE COMPENSATED CURRENT REFERENCE CIRCUIT

(75) Inventors: Sanjay K. Wadhwa, Noida (IN); Saurabh Srivastava, Jhansi (IN)

(73) Assignee: Freescale Semiconductor, Inc., Austin, TX (US)

( * ) Notice: Subject to any disclaimer, the term of this patent is extended or adjusted under 35 U.S.C. 154(b) by 7 days.

(21) Appl. No.: 12/687,849

(22) Filed: Jan. 14, 2010

(51) Int. Cl.
*G05F 1/10* (2006.01)

(52) U.S. Cl. ..... 327/513; 327/538

(58) Field of Classification Search ..... 327/512, 327/513, 538, 543
See application file for complete search history.

(56) References Cited

U.S. PATENT DOCUMENTS

| | | | | |
|---|---|---|---|---|
| 6,738,297 | B2 | 5/2004 | Di Iorio | |
| 6,911,861 | B2 * | 6/2005 | Deng | 327/513 |
| 7,372,316 | B2 | 5/2008 | Chatterjee et al. | |
| 7,456,678 | B2 * | 11/2008 | Passerini et al. | 327/538 |
| 7,888,987 | B2 * | 2/2011 | Horie | 327/513 |

OTHER PUBLICATIONS

Banba et al, "A CMOS Bandgap Reference Circuit With Sub 1-V Operation", IEEE JSSC, May 1999.

* cited by examiner

*Primary Examiner* — Hai L Nguyen
(74) *Attorney, Agent, or Firm* — Charles Bergere

(57) ABSTRACT

A temperature compensated current reference circuit has a differential amplifier and a first feedback transistor with a gate coupled to the differential amplifier output. The first feedback transistor couples a supply voltage line to an inverting input of the differential amplifier. There is also a second feedback transistor with a gate coupled to the differential amplifier output, which couples the supply voltage line to a non-inverting input of the differential amplifier. A first temperature dependent conductor couples the inverting input to ground. A primary reference resistor and a second temperature dependent conductor are connected in series and couple the non-inverting input to ground. An output current control transistor has a gate and one other electrode coupled together and a third electrode coupled to the supply voltage line. A secondary reference resistor and a conductivity change sensing transistor are connected in series and couple the gate of the output current control transistor to ground. The conductivity change sensing transistor has a gate coupled to the second one of the two differential inputs. There is a temperature compensation current reference output circuit that has a current reference transistor, an input coupled to the differential amplifier output and another input is coupled to the gate of the output current control transistor.

20 Claims, 4 Drawing Sheets

TEMPERATURE COMPENSATED CURRENT REFERENCE CIRCUIT

BACKGROUND OF THE INVENTION

The present invention relates to temperature compensated current reference circuits. More specifically, the present invention relates to temperature compensated current reference circuits that use both a Proportional To Absolute Temperature (PTAT) current reference and an Inversely Proportional To Absolute Temperature (ITAT) current reference.

Temperature compensated current reference circuits typically employ both a PTAT current reference and an ITAT current reference. Numerous electronic circuits including current controlled oscillators, precision amplifiers and voltage regulators use temperature compensated current reference circuits in order to limit performance inaccuracies that are often caused by ambient temperature variations.

A typical PTAT current reference uses a resistor and two semiconductors of different sizes to generate a temperature dependent voltage across the resistor. The PTAT current reference has a PTAT operational amplifier, configured as a high gain differential amplifier, so that its two inputs are substantially at the same voltage. Any difference in voltage across the semiconductors, due to ambient temperature variations, is applied across the resistor and therefore the output of the PTAT operational amplifier is dependent on the current flowing through the resistor.

A typical ITAT current reference uses an ITAT operational amplifier configured as a gain differential amplifier with a semiconductor connected to one input of the differential amplifier and a resistor connected to the other input of the operational amplifier. Again, voltage variations across the ITAT configured semiconductor, due to ambient temperature variations, are applied across the resistor and therefore the output of the ITAT operational amplifier is dependent on the current flowing through the resistor.

Temperature compensated current reference circuits also typically use a current summing circuit that combines two current sources to create a combined current. One of the current sources is controlled by an output from the PTAT operational amplifier and the other one of the current sources is controlled by an output from the ITAT operational amplifier. Hence, in operation the combined current stays substantially constant, for variations in ambient temperature, since current variations in the current source controlled by the output from the PTAT operational amplifier are cancelled by current variations in the current source controlled by the output from the ITAT operational amplifier.

The above temperature compensated current reference circuits provide a relatively accurate temperature independent constant current source. However, the silicon area may be unnecessarily large, especially since the PTAT and ITAT current references each require an operational amplifier that is typically fabricated from about seven transistors plus associated biasing transistors, resistors and compensation capacitors.

BRIEF DESCRIPTION OF THE DRAWINGS

The invention, together with objects and advantages thereof, may best be understood by reference to the following description of preferred embodiments together with the accompanying drawings in which.

DETAILED DESCRIPTION OF PREFERRED EMBODIMENTS

Figure 1:
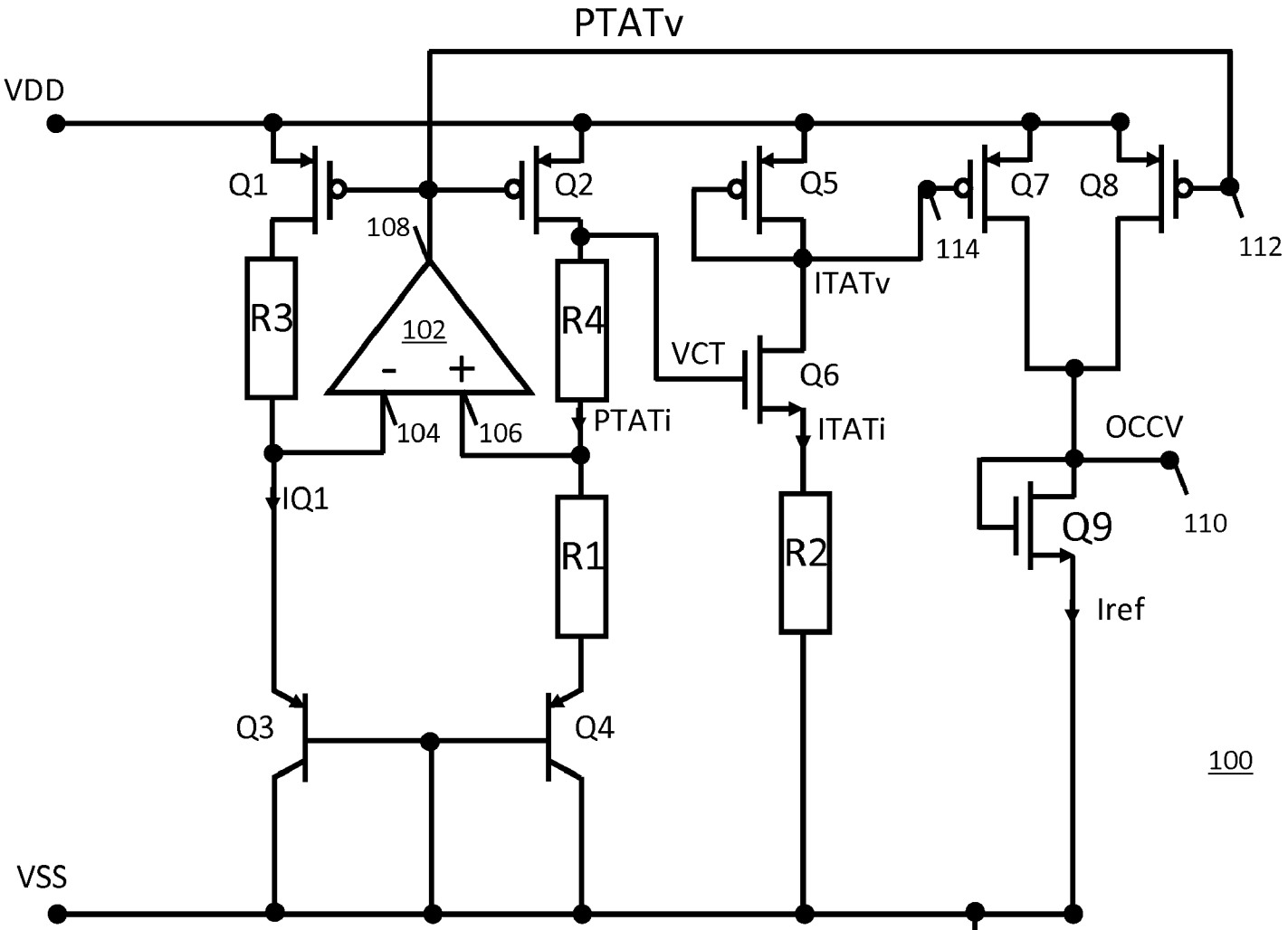
FIG. 1 is a schematic circuit diagram of a temperature compensated current reference circuit in accordance with an embodiment of the present invention.

The detailed description set forth below in connection with the appended drawings is intended as a description of presently preferred embodiments of the invention, and is not intended to represent the only forms in which the present invention may be practiced. It is to be understood that the same or equivalent functions may be accomplished by different embodiments that are intended to be encompassed within the spirit and scope of the invention. In the drawings, like numerals are used to indicate like elements throughout. Furthermore, the terms "comprises," "comprising," or any other variation thereof, are intended to cover a non-exclusive inclusion, such that circuit, device components and method steps that comprises a list of elements or steps does not include only those elements but may include other elements or steps not expressly listed or inherent to such circuit, device components or steps. An element or step proceeded by "comprises . . . a" does not, without more constraints, preclude the existence of additional identical elements or steps that comprises the element or step. The term coupled means in electrical communication, whether directly connected via a wire, connected by way of another circuit element, or connected I another manner such as wirelessly or inductively. Also, where appropriate and unless specified otherwise, any four electrode Field Effect Transistor mentioned in this document has its source and the body (substrate) electrodes connected together.

In one embodiment, the present invention provides a temperature compensated current reference circuit comprising differential amplifier having two differential inputs and a differential amplifier output. There is a first feedback transistor with a control electrode coupled to the differential amplifier output, the first feedback transistor provides a coupling of a first voltage reference node to a first one of the two differential inputs. There is also a second feedback transistor with a control electrode coupled to the differential amplifier output. The second feedback transistor provides a coupling of the first voltage reference node to a second one of the two differential inputs.

The temperature compensated current reference circuit has a first temperature dependent conductor coupling the first one of the two differential inputs to a second voltage reference node. There is a primary reference resistor and a second temperature dependent conductor having a conductivity that is greater than a conductivity of the first temperature dependent conductor for a given temperature. The second temperature dependent conductor is connected in series with the primary reference resistor and the second temperature dependent conductor and primary reference resistor couple the second one of the two differential inputs to the second voltage reference node. The temperature compensated current reference circuit also has an output current control transistor with a control electrode and one other electrode coupled together and a third electrode coupled to the first voltage reference node. There is also a secondary reference resistor and a conductivity change sensing transistor connected in series with the secondary reference resistor. The conductivity change sensing transistor has a control electrode coupled to the second one of the two differential inputs. The conductivity change sensing transistor and secondary reference resistor couple the control electrode of the output current control transistor to the second voltage reference node.

There is also a temperature compensated current reference output circuit having a current reference transistor and two control inputs. A first one of the control inputs is coupled to the differential amplifier output and a second one of the control inputs is coupled to the control electrode of the output current control transistor.

In another embodiment, the present invention provides a temperature compensated current reference circuit comprising differential amplifier having two differential inputs and a differential amplifier output. There is a first feedback transistor with a control electrode coupled to the differential amplifier output, the first feedback transistor provides a coupling of a first voltage reference node to a first one of the two differential inputs. There is also a second feedback transistor with a control electrode coupled to the differential amplifier output, the second feedback transistor provides a coupling of the first voltage reference node to a second one of the two differential inputs.

The temperature compensated current reference circuit has a first temperature dependent conductor coupling the first one of the two differential inputs to a second voltage reference node. There is a primary reference resistor and a second temperature dependent conductor having a conductivity that is greater than a conductivity of the first temperature dependent conductor for a given temperature. The second temperature dependent conductor is connected in series with the primary reference resistor and the second temperature dependent conductor and primary reference resistor couple the second one of the two differential inputs to the second voltage reference node. The temperature compensated current reference circuit also has an output current control transistor with a control electrode and one other electrode coupled together and a third electrode coupled to the first voltage reference node. There is also a secondary reference resistor and a conductivity change sensing transistor connected in series with the secondary reference resistor. The conductivity change sensing transistor has a control electrode coupled to the second one of the two differential inputs. The conductivity change sensing transistor and secondary reference resistor couple the control electrode of the output current control transistor to the second voltage reference node.

There is also a temperature compensated current reference output circuit having a current reference transistor and two control inputs. A first one of the control inputs is coupled to the differential amplifier output and a second one of the control inputs is coupled to the control electrode of the output current control transistor. In operation, variations in ambient temperature alter voltages at the first one of the control inputs and the second one of the control inputs so that the output current flowing in the current reference transistor remains constant.

Referring to FIG. 1 there is illustrated a schematic circuit diagram of a temperature compensated current reference circuit 100 in accordance with an embodiment of the present invention. The temperature compensated current reference circuit 100 includes a differential amplifier 102 in the form of an operational amplifier that has two differential inputs. A first one of the two differential inputs is an inverting input 104 and a second one of the two differential inputs is a non-inverting input 106. The differential amplifier 102 also has a differential amplifier output 108 that provides a PTAT control voltage PTATv that will be referred to later.

There is a first feedback transistor Q1 with a control electrode or gate coupled to the differential amplifier output 108. The first feedback transistor Q1 provides a coupling of a first voltage reference node VDD (a supply voltage line) to the inverting input 104. The temperature compensated current reference circuit 100 has a second feedback transistor Q2 with a control electrode or gate coupled to the differential amplifier output 108. The second feedback transistor Q2 provides a coupling of the first voltage reference node VDD to the non-inverting input 106.

There is a first temperature dependent conductor in the form of a bipolar transistor Q3 coupling the inverting input 104 to a second voltage reference node VSS that is typically ground (GND). There is also a primary reference resistor R1 and a second temperature dependent conductor in the form of a bipolar transistor Q4 and bipolar transistor Q4 has a conductivity that is greater than a conductivity of the bipolar transistor Q3 for a given temperature. This greater conductivity of bipolar transistor Q4 is typically obtained by fabricating the bipolar transistor Q4 from a greater surface area of silicon than that used to fabricate the bipolar transistor Q3. Specifically, the emitter area of Q4 is made higher than the emitter area of Q3. Consequently, the bipolar transistor Q3 is smaller than the bipolar transistor Q4.

The bipolar transistor Q4 is connected in series with the primary reference resistor R1 and the bipolar transistor Q4 and primary reference resistor R1 couple the non-inverting input 106 to the second voltage reference node VSS. The bipolar transistors Q3 and Q4 are temperature sensing transistors with control electrodes in the form of base electrodes that are coupled directly together. The control electrodes of these bipolar transistors Q3 and Q4 are also each coupled directly to another electrode (the collector electrode) of each of the bipolar transistors Q3 and Q4 and are also coupled to the second voltage reference node VSS (ground GND). Accordingly, the base and collector electrode of both bipolar transistors Q3 and Q4 are at the same potential (specifically VSS or ground GND in this embodiment). It will therefore be apparent that the temperature dependent conductors are formed from each PN junction between an emitter electrode and base electrode of respective bipolar transistors Q3 and Q4.

As shown in this embodiment of the temperature compensated current reference circuit 100, the first feedback transistor Q1 couples the first voltage reference node VDD to the inverting input 104 through a first biasing resistor R3 and the second feedback transistor Q2 couples the first voltage reference node VDD to the non-inverting input 106 through a second biasing resistor R4. Also, in this embodiment, bipolar transistors Q3 and Q4 are PNP transistors and the feedback transistors Q1 and Q2 are P-type Field Effect Transistors.

The temperature compensated current reference circuit 100 has an output current control transistor Q5 with a control electrode or gate and one other electrode (drain electrode) coupled together and a third electrode (source electrode) coupled to the first voltage reference node VDD. The control electrode or gate electrode of the output current control transistor Q5 provides an ITAT control voltage ITATv that will be referred to later. There is a secondary reference resistor R2 and a conductivity change sensing transistor Q6 connected in series with the secondary reference resistor R2. The conductivity change sensing transistor Q6 has a control electrode or gate coupled to the non-inverting input 106 via the second biasing resistor R4. It should be noted, that since the voltages at both the inverting input 104 and the non-inverting input 106 are substantially the same, it is also possible to connect the control electrode or gate of conductivity change sensing transistor Q6 to the inverting input 104 via the first biasing resistor R3.

In operation, a control voltage VCT is applied to the gate of conductivity change sensing transistor Q6 that is dependent on a PTAT current PTATi flowing through the primary reference resistor R1. The conductivity change sensing transistor Q6 and the secondary reference resistor R2 couple the control electrode or gate of the output current control transistor Q5 to the second voltage reference node VSS (ground GND). Also, in this embodiment, the output current control transistor Q5 is a P-type Field Effect Transistor, whereas the conductivity change sensing transistor Q6 is an N-type Field Effect Transistor.

There is also a temperature compensated current reference output circuit 100 having a temperature compensated current reference transistor Q9, a current reference output 110 and two control inputs. A first one of the control inputs 112 is coupled to the differential amplifier output 108 and a second one of the control inputs 114 is coupled to the control electrode or gate of the output current control transistor Q5.

The temperature compensated current reference output circuit, as shown, is a current summation circuit that includes two parallel coupled input transistors Q7 and Q8 (N-type Field Effect Transistors) coupled in series with a temperature compensated current reference transistor Q9. The temperature compensated current reference transistor Q9 is an N-type Field Effect Transistor that has a control electrode or gate and one other electrode (drain electrode) coupled together. The gate of the input transistor Q7 provides the second one of the control inputs 114 and the gate of the input transistor Q8 provides the first one of the control inputs 112. The source electrodes of the input transistors Q7 and Q8 are coupled to the first voltage reference node VDD and the source electrode of the temperature compensated current reference transistor Q9 is coupled to the second voltage reference node VSS. Furthermore, the current reference output 110 is coupled to the control electrode or gate of the temperature compensated current reference transistor Q9. In operation, a reference current Iref flows through the temperature compensated current reference transistor Q9 and the current reference output 110 provides an Output Current Control Voltage OCCV that is dependent on the reference current Iref.

When the temperature compensation current reference circuit 100 is in operation, there is a small voltage difference between the inverting input 104 and non-inverting input 106 even though they both are coupled by identical feedback loops to the differential amplifier output 108. The amount of PTAT current PTATi flowing through bipolar transistor Q4 is the same as a current IQ1 flowing through bipolar transistor Q3. Accordingly, the voltage at the emitter electrode of bipolar transistor Q4 is lower than the voltage at emitter electrode of bipolar transistor Q3. This is because bipolar transistor Q4 has a greater conductivity than bipolar transistor Q3. This difference in voltage at the emitter electrodes of transistors Q3, Q4 appears across the primary reference resistor R1. This voltage across the primary reference resistor R1 increases with an increase in ambient temperature.

The PTAT current PTATi flowing through bipolar transistor Q4 and the current IQ1 flowing through bipolar transistor Q3 can be determined by the following equation:

$$PTATi = IQ1 = \frac{V_T \ln(m)}{R_1} = \frac{kT\ln(m)}{qR_1}$$

where, $V_T$ is voltage equivalent of temperature (thermal voltage), m is the emitter area ratio of bipolar transistors Q3 and Q4, q is the Boltzman constant, T is the absolute temperature.

It is clear from the above expression that as temperature increases, the PTAT current PTATi increases. In other words, the temperature coefficient of current PTATi is positive. In steady state, the differential amplifier output 108 stabilizes to a PTAT control voltage PTATv corresponding to the PTAT current PTATi. There is an overall negative feedback in the circuit and as the temperature changes, so does the PTAT current PTATi and the PTAT control voltage PTATv adjusts itself to support the new value of the PTAT current PTATi. For example, if ambient temperature decreases, the PTAT current PTATi decreases and the first and second feedback transistors Q1 and Q2 require less gate to source voltage resulting in the PTAT control voltage PTATv increasing. Similarly, if ambient temperature increases, the PTAT current PTATi increases. Thus, the first and second feedback transistors Q1 and Q2 require more gate to source voltage and the PTAT control voltage PTATv decreases.

From the above it is clear that in operation due to the overall negative feedback in the circuit 100, voltages at both the differential inputs 104, 106 of the differential amplifier 102 are substantially the same. As ambient temperature increases, the base to emitter voltage of bipolar transistors Q3 and Q4 decreases. Accordingly, a control voltage VCT applied to the gate of conductivity change sensing transistor Q6 will decrease resulting in a decrease in voltage across the secondary reference resistor R2. This will reduce the current flowing in the secondary reference resistor R2, conductivity change sensing transistor Q6 and the output current control transistor Q5 because all of them are connected in series. Consequently, the output current control transistor Q5 will require less gate to source voltage and therefore the ITAT control voltage ITATv at the gate of the output current control transistor Q5 increases.

The equation of ITAT current ITATi flowing through the output current control transistor Q5 can be given as:

$$ITATi = \frac{V_{be} + (PTATi * R_4) - V_{gs}}{R_2}$$

where Vbe is the base to emitter voltage of the bipolar transistor Q4, PTATi*R4 is the voltage drop across the second biasing resistor R4 and Vgs is the gate to source voltage of conductivity change sensing transistor Q6. The conductivity change sensing transistor Q6 and secondary reference resistor R2 act as a level shifter. Since the base to emitter voltage (Vbe) of bipolar transistors Q3 and Q4 decrease with increase in ambient temperature, the voltage across the secondary reference resistor R2 also decreases. Thus, the ITAT current ITATi also decrease with increase in ambient temperature. In other words, the temperature coefficient of the ITAT current ITATi is negative.

The temperature compensated current reference circuit 100 has components and biasing selected such that any variation in ambient temperature that causes a variation in the PTAT current PTATi in the primary reference resistor R1 and in the ITAT current ITATi in the secondary reference resistor R2 cancel out each other. Hence, the circuit 100 generates a substantially temperature independent reference current Iref flowing through the temperature compensated current reference transistor Q9.

Figure 2:
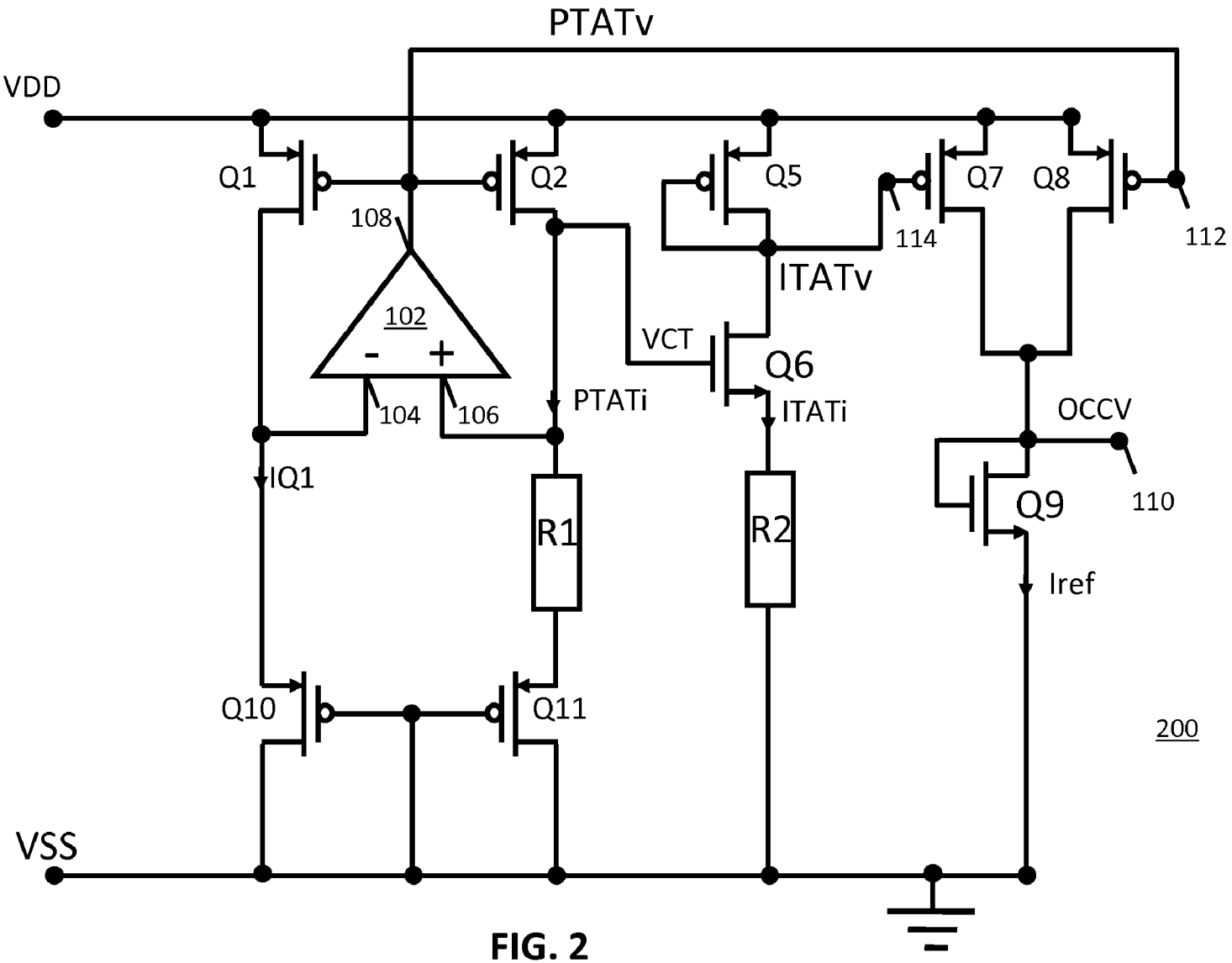
FIG. 2 is a schematic circuit diagram of a temperature compensated current reference circuit in accordance with another embodiment of the present invention.

Referring to FIG. 2 there is illustrated a schematic circuit diagram of a temperature compensated current reference circuit 200 in accordance with another embodiment of the present invention. As most of the circuitry has been described above with reference to FIG. 1, a repetitive description of this circuitry is not required for one of skill in the art to understand the invention and only the differences will be described. As shown, the temperature compensated current reference circuit 200 has P-type Field Effect Transistors Q10 and Q11 that replace the bipolar transistors Q3 and Q4. These Field Effect Transistors Q10 and Q11 provide the same temperature dependent conductor function as the bipolar transistors Q3 and Q4. This is achieved by biasing the P-type Field Effect Transistors Q10 and Q11 in sub-threshold region of operation in which Field Effect Transistors essentially act as bipolar transistors. Accordingly, Field Effect Transistor Q11 has a conductivity that is greater than a conductivity of the Field Effect Transistor Q10 for a given temperature. This greater conductivity of Field Effect Transistor Q11 is typically obtained by fabricating the Field Effect Transistors Q11 from a greater surface area of silicon than that used to fabricate the Field Effect Transistor Q10. Consequently, the Field Effect Transistor Q10 is smaller than the Field Effect Transistors Q11.

In this embodiment, the biasing of the temperature compensated current reference circuit 200 is such that there may or may not be a need for the first and second biasing resistors R3 and R4 and as illustrated the first and second biasing resistors R3 and R4 have been omitted. Accordingly, since the first and second biasing resistors R3 and R4 are optionally omitted in this embodiment, the drain electrode of the first feedback transistor Q1 is directly coupled to the inverting input 104 and the drain electrode of the second feedback transistor Q2 is directly coupled to the non-inverting input 106.

Figure 3:
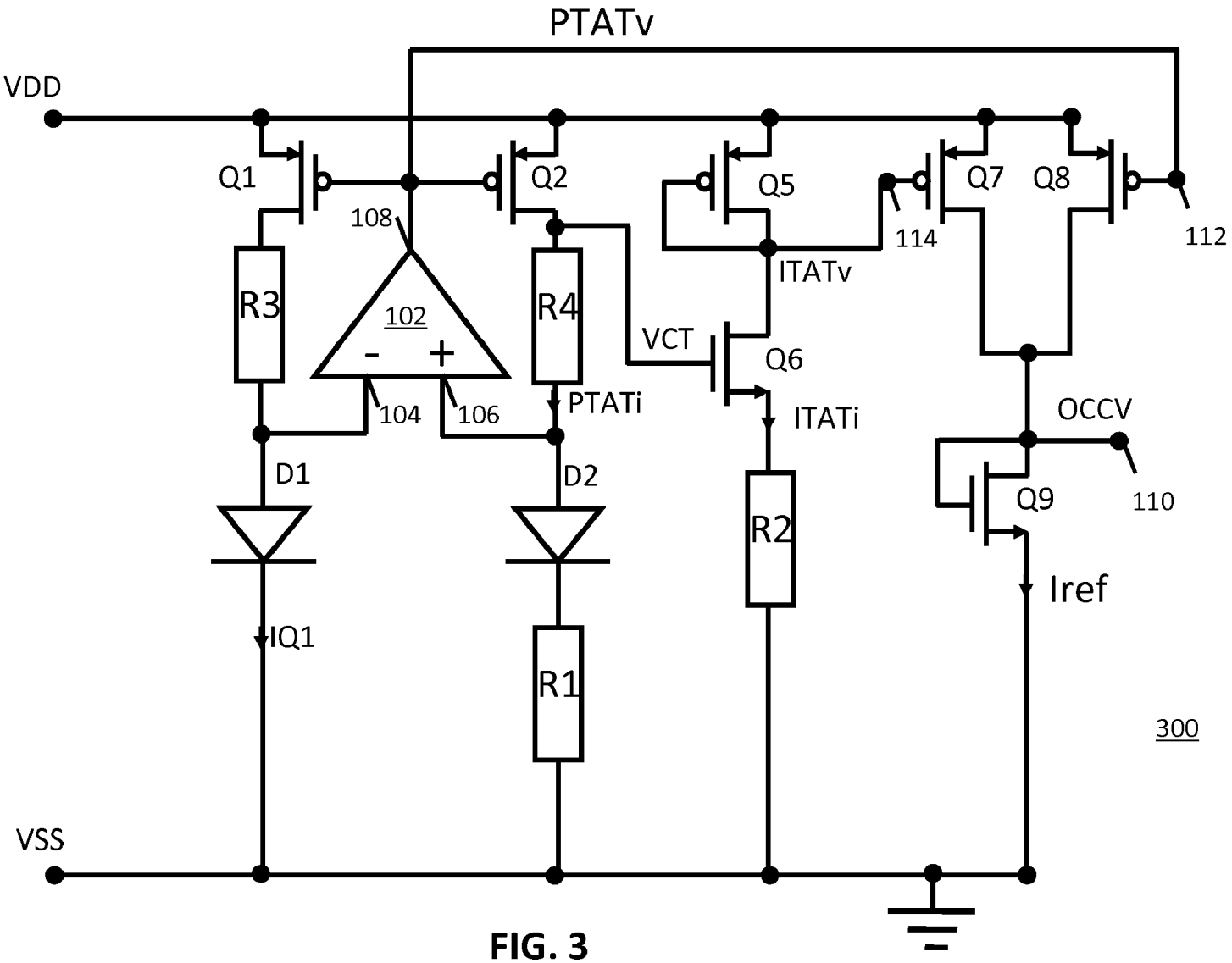
FIG. 3 is a schematic circuit diagram of a temperature compensated current reference circuit in accordance with a further embodiment of the present invention.

Referring to FIG. 3 there is illustrated a schematic circuit diagram of a temperature compensated current reference circuit 300 in accordance with a further embodiment of the present invention. Again, as most of the circuitry has been described above with reference to FIG. 1, a repetitive description of this circuitry is not required for one of skill in the art to understand the invention and only the differences will be described. As shown, the temperature compensated current reference circuit 300 has diodes D1 and D2 that replace the bipolar transistors Q3 and Q4. These diodes D1 and D2 are PN junctions and provide the same temperature dependent conductor function as the bipolar transistors Q3 and Q4. Accordingly, diode D2 has a conductivity that is greater than a conductivity of the diode D1 for a given temperature. This greater conductivity of diode D2 is typically obtained by fabricating the diode D2 from a greater surface area of silicon than that used to fabricate the diode D1. Consequently, diode D1 is smaller than diode D2.

In this embodiment, of the temperature compensated current reference circuit 300 the primary reference resistor R1 is coupled between diode D2 and the second voltage reference node VSS. However, as an alternative the primary reference resistor R1 could be coupled between the diode D2 and non-inverting input 106.

Figure 4:
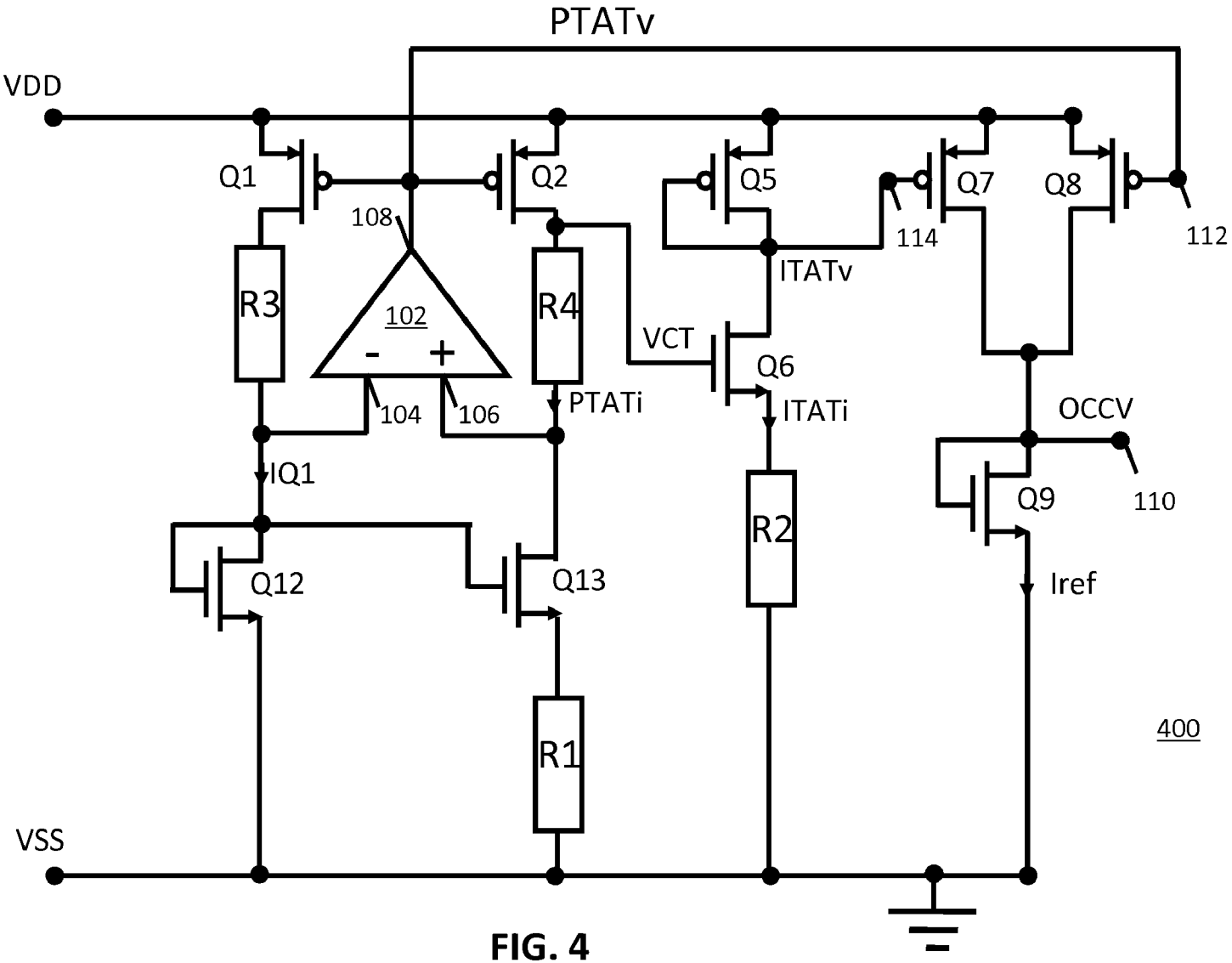
FIG. 4 is a schematic circuit diagram of a temperature compensated current reference circuit in accordance with one further embodiment of the present invention.

Referring to FIG. 4 there is illustrated a schematic circuit diagram of a temperature compensated current reference circuit 400 in accordance with one further embodiment of the present invention. As most of the circuitry has been described above with reference to FIG. 1, a repetitive description of this circuitry is not required for one of skill in the art to understand the invention and only the differences will be described. As shown, the temperature compensated current reference circuit 400 has N-type Field Effect Transistors Q12 and Q13 that replace the bipolar transistors Q3 and Q4. These Field Effect Transistors Q12 and Q13 provide the same temperature dependent conductor function as the bipolar transistors Q3 and Q4. This is achieved by biasing the N-type Field Effect Transistors Q12 and Q13 in sub-threshold region of operation in which Field Effect Transistors essentially act as bipolar transistors. Accordingly, Field Effect Transistor Q13 has a conductivity that is greater than a conductivity of the Field Effect Transistor Q12 for a given ambient temperature. This greater conductivity of Field Effect Transistor Q13 is typically obtained by fabricating the Field Effect Transistors Q13 from a greater surface area of silicon than that used to fabricate the Field Effect Transistor Q12. Consequently, the Field Effect Transistor Q12 is smaller than the Field Effect Transistors Q13.

In this embodiment, the gate and drain electrodes of transistor Q12 are coupled together and the gate electrode of transistor Q13 is coupled to the gate of transistor Q12. Also, the primary reference resistor R1 is coupled between the source electrode of transistor Q13 and ground GND.

As is evident from the foregoing, the temperature compensated current reference circuits 200, 300 and 400 operate in a similar manner to that of temperature compensated current reference circuit 100. It will therefore be apparent to one of skill in the art that the present invention provides for a temperature compensated current reference circuits in which the reference current Iref flowing in the temperature compensated current reference transistor Q9 remains substantially constant for variations in ambient temperature. Also, the Output Current Control Voltage OCCV adjusts itself according to the temperature compensated reference current Iref flowing through the temperature compensated current reference transistor Q9. This Output Current Control Voltage OCCV is typically used to drive a transistor in a current mirror in which the temperature compensated current reference transistor Q9 is the current control transistor for the current mirror. The reference current Iref flowing through the temperature compensated current reference transistor Q9 remains substantially constant because the PTAT current PTATi flowing in the primary reference resistor R1 and the ITAT current ITATi flowing in the secondary reference resistor R2 vary by opposite but equal amounts for variations in the ambient temperature.

Advantageously, the present invention uses variations in voltage across the primary reference resistor R1 to both control the PTAT control voltage PTATv and the ITAT control voltage ITATv whilst only requiring one operational amplifier (differential amplifier 102). In contrast, prior art temperature compensated current reference circuits typically require one operational amplifier to control the PTAT control voltage PTATv and a second operational amplifier to control the ITAT control voltage ITATv. The present invention therefore eliminates the need for the second operational amplifiers that results in a silicon real estate saving equal to approximately seven transistors, associated biasing transistors, compensation capacitors and resistors.

As will be apparent to one skilled in the art, the above embodiments may be implemented in any form of transistor technology such as Metal Oxide Semiconductor, using bipolar transistors or otherwise, as such throughout this specification the terms gate, source and drain can be readily substituted for base emitter and collector and vice versa.

The description of the preferred embodiments of the present invention has been presented for purposes of illustration and description, but is not intended to be exhaustive or to limit the invention to the forms disclosed. It will be appreciated by those skilled in the art that changes could be made to the embodiments described above without departing from the broad inventive concept thereof. For instance, the biasing of the temperature compensated current reference circuits in all the embodiments herein may be such that the first and second biasing resistors R3 and R4 can be optionally omitted. It is understood, therefore, that this invention is not limited to the particular embodiment disclosed, but covers modifications within the spirit and scope of the present invention as defined by the appended claims.

The invention claimed is:

1. A temperature compensated current reference circuit comprising:

a differential amplifier having two differential inputs and a differential amplifier output;

a first feedback transistor with a control electrode coupled to the differential amplifier output, the first feedback transistor providing a coupling of a first voltage reference node to a first one of the two differential inputs;

a second feedback transistor with a control electrode coupled to the differential amplifier output, the second feedback transistor providing a coupling of the first voltage reference node to a second one of the two differential inputs;

a first temperature dependent conductor coupling the first one of the two differential inputs to a second voltage reference node;

a primary reference resistor;

a second temperature dependent conductor having a conductivity that is greater than a conductivity of the first temperature dependent conductor for a given temperature, wherein the second temperature dependent conductor is connected in series with the primary reference resistor and the second temperature dependent conductor and primary reference resistor couple the second one of the two differential inputs to the second voltage reference node;

an output current control transistor having a control electrode and one other electrode coupled together and a third electrode coupled to the first voltage reference node, a secondary reference resistor;

a conductivity change sensing transistor connected in series with the secondary reference resistor, the conductivity change sensing transistor having a control electrode coupled to the second one of the two differential inputs, wherein the conductivity change sensing transistor and secondary reference resistor couple the control electrode of the output current control transistor to the second voltage reference node; and a temperature compensated current reference output circuit having a current reference transistor and two control inputs, a first one of the control inputs is coupled to the differential amplifier output and a second one of the control inputs is coupled to the control electrode of the output current control transistor.

2. The temperature compensated current reference circuit of claim 1, wherein the first temperature dependent conductor and the second temperature dependent conductor are temperature sensing transistors.

3. The temperature compensated current reference circuit of claim 1, wherein the first temperature dependent conductor and the second temperature dependent conductor comprise PN junctions.

4. The temperature compensated current reference circuit of claim 1, wherein the first temperature dependent conductor and the second temperature dependent conductor are bipolar transistors.

5. The temperature compensated current reference circuit of claim 1, wherein the first temperature dependent conductor and the second temperature dependent conductor are field effect transistors.

6. The temperature compensated current reference circuit of claim 1, wherein the first temperature dependent conductor is smaller than the second temperature dependent conductor.

7. The temperature compensated current reference circuit of claim 1, wherein in operation a voltage across the primary reference resistor increases with an increase in ambient temperature that affects the conductivity of both the first temperature dependent conductor and the second temperature dependent conductor.

8. The temperature compensated current reference circuit of claim 1, wherein the first feedback transistor couples the first voltage reference node to a first one of the two differential inputs through a first biasing resistor and the second feedback transistor couples the first voltage reference node to a second one of the two differential inputs through a second biasing resistor.

9. The temperature compensated current reference circuit of claim 8, wherein the first one of the two differential inputs is an inverting input and the second one of the two differential inputs is a non-inverting input.

10. The temperature compensated current reference circuit of claim 1, wherein, for a change in ambient temperature, current flowing in the primary reference resistor and current flowing in the secondary reference resistor vary by opposite equal amounts.

11. The temperature compensated current reference circuit of claim 10, wherein the temperature compensation current reference output circuit is a current summation circuit.

12. The temperature compensated current reference circuit of claim 11, wherein current flowing through the current reference transistor remains constant for variations in ambient temperature.

13. The temperature compensated current reference circuit of claim 12, wherein the current summation circuit includes two parallel coupled input transistors coupled in series with a temperature compensated current reference transistor, wherein the temperature compensated current reference transistor has a control electrode and one other electrode coupled together.

14. A temperature compensated current reference circuit comprising:

a differential amplifier having two differential inputs and a differential amplifier output;

a first feedback transistor with a control electrode coupled to the differential amplifier output, the first feedback transistor providing a coupling of a first voltage reference node to a first one of the two differential inputs;

a second feedback transistor with a control electrode coupled to the differential amplifier output, the second feedback transistor providing a coupling of the first voltage reference node to a second one of the two differential inputs;

a first temperature dependent conductor coupling the first one of the two differential inputs to a second voltage reference node;

a primary reference resistor;

a second temperature dependent conductor having a conductivity that is greater than a conductivity of the first temperature dependent conductor for a given temperature, wherein the second temperature dependent conductor is connected in series with the primary reference resistor and the second temperature dependent conductor and the primary reference resistor couple the second one of the two differential inputs to the second voltage reference node;

an output current control transistor having a control electrode and one other electrode coupled together and a third electrode coupled to the first voltage reference node, a secondary reference resistor;

a conductivity change sensing transistor connected in series with the secondary reference resistor, the conductivity change sensing transistor having a control electrode coupled to the second one of the two differential inputs, wherein the conductivity change sensing transistor and secondary reference resistor couple the control electrode of the output current control transistor to the second voltage reference node; and a temperature compensated current reference output circuit having a current reference transistor and two control inputs, a first one of the control inputs is coupled to the differential amplifier output and a second one of the control inputs is coupled to the control electrode of the output current control transistor, wherein variations in ambient temperature alter voltages at the first one of the control inputs and the second one of the control inputs so that the output current flowing in the current reference transistor remains constant.

15. The temperature compensated current reference circuit of claim 14, wherein the first temperature dependent conductor is smaller than the second temperature dependent conductor.

16. The temperature compensated current reference circuit of claim 14, wherein in operation a voltage across the primary reference resistor increases with an increase in ambient temperature.

17. The temperature compensated current reference circuit of claim 14, wherein variations in voltage across the primary reference resistor alter voltages at the first one of the control inputs and the second one of the control inputs.

18. The temperature compensated current reference circuit of claim 14, wherein the temperature compensation current reference output circuit is a current summation circuit.

19. The temperature compensated current reference circuit of claim 14, wherein the current summation circuit includes two parallel coupled input transistors coupled in series with a temperature compensated current reference transistor, and wherein the current reference transistor has a control electrode and one other electrode coupled together.

20. The temperature compensated current reference circuit of claim 19, wherein a current reference output is coupled to the control electrode of the current reference transistor, and in operation, the current reference output provides an output current control voltage that is dependent on the reference current.

* * * * *